US010775136B2

(12) United States Patent
Walker et al.

(10) Patent No.: US 10,775,136 B2
(45) Date of Patent: Sep. 15, 2020

(54) EDGE-ON ARMOR SYSTEM WITH TRANSLATING AND ROTATING ARMOR PANELS

(71) Applicant: Southwest Research Institute, San Antonio, TX (US)

(72) Inventors: James D. Walker, San Antonio, TX (US); Daniel J. Pomerening, San Antonio, TX (US); Kristopher C. Kozak, San Antonio, TX (US); Nicholas J. Mueschke, San Antonio, TX (US); Isaias S. Chocron, San Antonio, TX (US); Gregory N. Wattis, San Antonio, TX (US); Jesse A. Beavers, Boerne, TX (US); Oliver P. Harrison, San Antonio, TX (US); Stephan J. Lemmer, Belleville, MI (US); Neal A. Seegmiller, Pittsburgh, PA (US)

(73) Assignee: Southwest Research Institute, San Antonio, TX (US)

( * ) Notice: Subject to any disclaimer, the term of this patent is extended or adjusted under 35 U.S.C. 154(b) by 300 days.

(21) Appl. No.: 15/963,881

(22) Filed: Apr. 26, 2018

(65) Prior Publication Data

US 2019/0331462 A1 Oct. 31, 2019

(51) Int. Cl.

| | |
|---|---|
| ***F41H 5/00*** | (2006.01) |
| ***F41H 5/007*** | (2006.01) |
| ***F41H 7/04*** | (2006.01) |
| *F41H 5/013* | (2006.01) |

(52) U.S. Cl.

CPC ..... *F41H 5/007* (2013.01); *F41H 7/04* (2013.01); *F41H 5/013* (2013.01)

(58) Field of Classification Search

CPC ..... F41H 5/007; F41H 7/04
USPC ..... 89/36.08
See application file for complete search history.

(56) References Cited

U.S. PATENT DOCUMENTS

| | | | | |
|---|---|---|---|---|
| 6,082,240 | A * | 7/2000 | Middione | F41H 5/013 296/187.07 |
| 6,604,776 | B2 * | 8/2003 | Edwards | B60R 25/016 296/152 |
| 7,789,010 | B2 * | 9/2010 | Allor | F41H 7/035 89/36.03 |
| 8,342,073 | B2 * | 1/2013 | Chu | F41H 5/223 89/36.01 |
| 9,097,497 | B2 * | 8/2015 | Corsetti | F41H 5/08 |
| 9,188,409 | B2 * | 11/2015 | Sagebiel | F41H 7/044 |
| 2007/0234895 | A1 * | 10/2007 | Singh | F41H 7/04 89/36.07 |

* cited by examiner

*Primary Examiner* — Joseph D Pape
(74) *Attorney, Agent, or Firm* — Livingston Law Firm

(57) ABSTRACT

An armor system for protecting vehicles and other equipment against projectiles and similar threats. A track is mounted on the equipment, and an upper sled and lower sled are moveably attached to the track. An armor panel is pivotally attached to one sled and is pivotally attached with arms to the other sled. The two sleds are independently actuated along the track, such that their relative positions determine both the translational and rotational position of the armor panel. The armor panel can be quickly rotated from an undeployed position against the vehicle through a desired arc outward from the vehicle, which increases the edge-on or nearly edge-on presentation of the armor panel to the projectile.

9 Claims, 8 Drawing Sheets

EDGE-ON ARMOR SYSTEM WITH TRANSLATING AND ROTATING ARMOR PANELS

GOVERNMENT SUPPORT CLAUSE

This invention was made with United States Government support under Contract No. W56HZV15C0129 funded by the Defense Advanced Research Projects Agency (DARPA). The Government has certain rights in this invention.

TECHNICAL FIELD OF THE INVENTION

This invention relates to protection of vehicles and heavy equipment from ballistic weaponry and similar projectile threats, and more particularly to an armor system that has moveable armor panels that both translate and rotate to provide edge-on protection.

BACKGROUND OF THE INVENTION

Military vehicles are commonly armored to withstand the impact of shrapnel, bullets, missiles or shells, protecting the personnel inside from enemy fire. Armored military vehicles can include tanks, aircraft and ships.

Civilian vehicles may also be armored. These vehicles include cars used by reporters, officials and others in conflict zones or where violent crime is common. Civilian armored cars are also routinely used by security firms to carry money or valuables to reduce the risk of robbery or the hijacking.

Armor may also be used to protect vehicles or other equipment from threats other than a deliberate attack. Some spacecraft are equipped with specialized armor to protect them against impacts from micrometeoroids or fragments of space junk. Modern aircraft powered by jet engines usually have the engine fitted with a sort of armor near the engine to prevent damage should parts of an engine break free.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

As indicated in the Background, for centuries there has been a need to armor vehicles of many types, including ground vehicles, water-going vehicles, aircraft, and now spacecraft. Today's armor systems must protect again serious threats, which include kinetic energy projectiles, shaped-charge-based warheads, and explosively formed penetrators. For this type of protection, the weight of conventional armor systems can be excessive.

The armor system described herein may be referred to as a "movable, rotatable, edge-on panel armor system". The thick, heavy, static armor emplacements of conventional armors are replaced with movable armor panels that can be rapidly and automatically moved into the path of a projectile to meet it edge-on, instead of through an armor's thickness. This edge-on protection increases the effective thickness of the armor that is presented to the threat.

The armor system has less volume and weight than a conventional "flat plate" armor system. It has been demonstrated that, for a ground vehicle, the armor system can achieve accurate deployment and position of a two-hundred-pound armor panel over a six-foot range in less than 0.4 seconds.

Armor Panels

Figure 1:
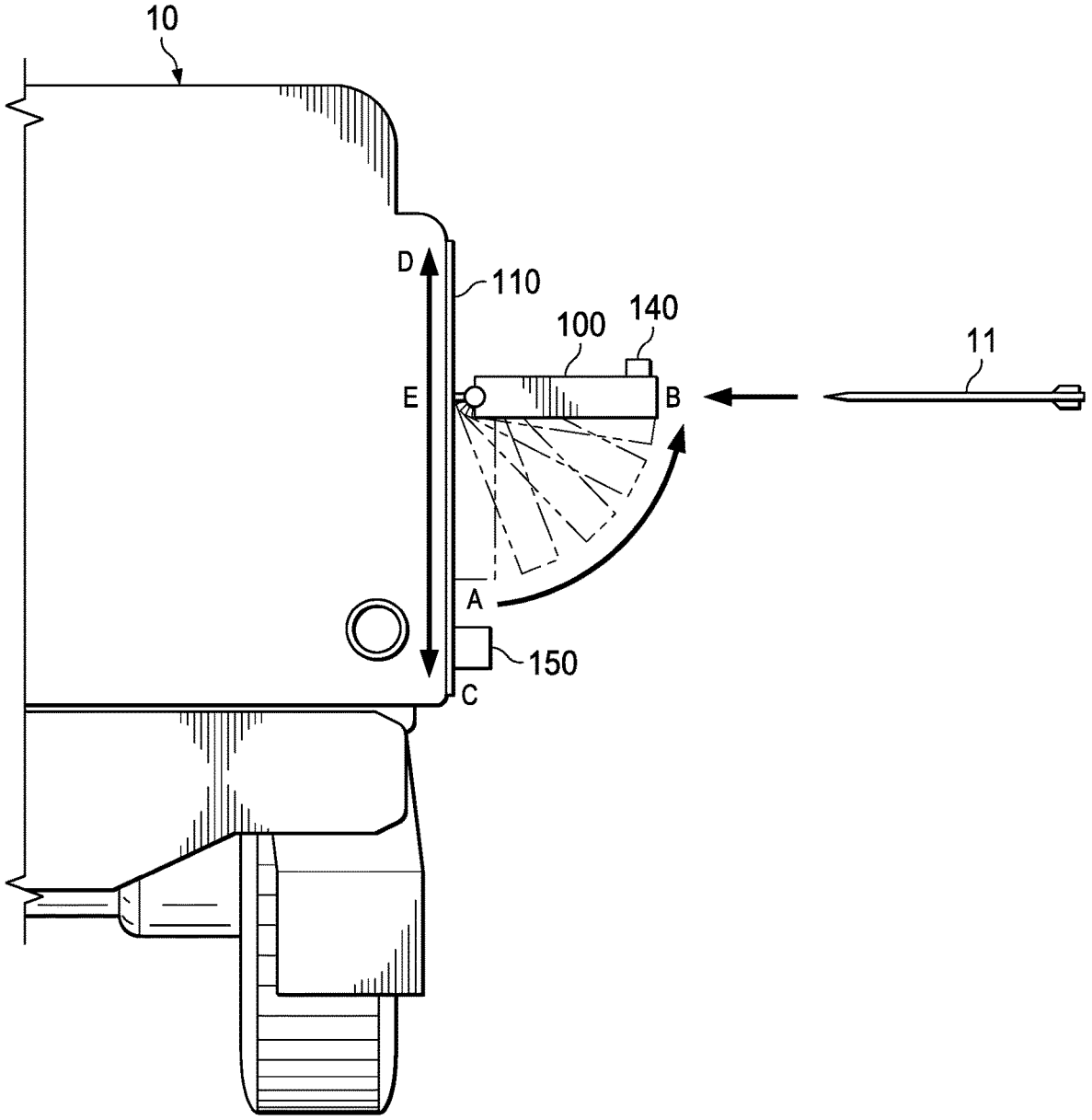
FIG. 1 is a side view of one armor panel installed on a vehicle, and further illustrates stages of deployment.

FIG. 1 illustrates one armor panel 100 installed on a vehicle, shown as a tank, 10. The armor panel 100 has been fully deployed to a ninety-degree rotation, and is in position to protect vehicle 10 against a projectile 11. Although vehicle 10 is shown with only one armor panel 100, any number of panels may be installed in various locations on the exterior surface of vehicle 100.

The illustration of armor panel 100 installed on a tank is for purposes of example. The same concepts apply to armor panels installed on other types of vehicles or other mobile or stationary equipment. The equipment on which one or more armor panels is installed may be referred to herein generally as the "protected equipment".

Also, the illustration of projectile 11 is for purposes of example. Armor panel 100 could be used for protection against various types of projectiles, debris, or other impingements, all referred to herein as "threats". Specific examples of threats include kinetic energy projectiles, shaped-charge-based warheads, such as found in RPGs and anti-tank guided missiles (ATGMs), and explosively formed projectiles (EFPs).

Figure 2:
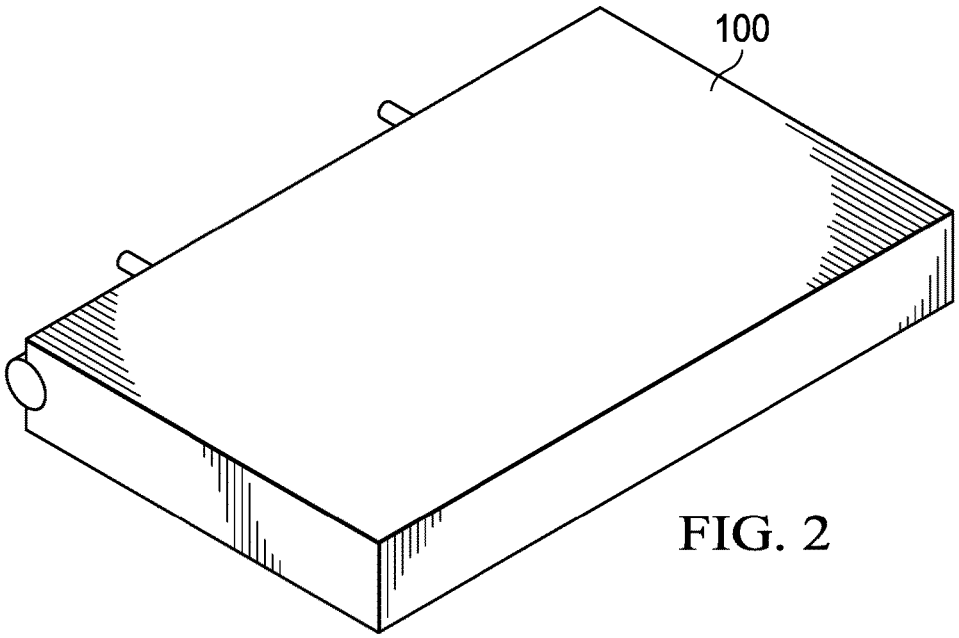
FIG. 2 is a perspective view, of the armor panel of FIG. 1.

FIG. 2 is a perspective view of armor panel 100. Referring to both FIGS. 1 and 2, in general, each armor panel 100 will be moveably attached to an associated track 110, which is mounted on the protected equipment 10, and which allows translational movement of armor panel 100. Not explicitly shown are additional mechanisms used to attach armor panel 100 to vehicle 10, and to allow translational and rotational movement of the panel. These mechanisms are described below in connection with FIGS. 6-9.

Each armor panel 100 further has an actuator 150 and a position monitor 140. As discussed below, various actuation devices are possible for producing rapid motion of an armor panel. Examples include electromagnetic or gas-generator actuators, as well as a combined electromechanical/gas generator actuator. In FIG. 1, actuator 150 is represented as a single unit, but as explained below, actuator 150 may be a system of parts, such as motors and gas generators.

The position monitor 140 detects the current position of the panel 100, particularly during deployment, and provides input to actuator 150. Position monitor 140 may have various implementations, such as fiducials on track 110 read by an encoder, or an inertial measurement unit on panel 100. As explained below, exact "edge-on" positioning of panel 100 toward an incoming threat is not required, but with appropriate threat detection and processing, actuator 150 could be programmed to provide edge-on or near edge-on positioning of panel 100.

Other input to actuator 150 includes activation signals in response to an incoming threat. It is to be understood that the armor system described herein addresses the motion and positioning of armor panels. It is assumed that the armor panels are activated in response to an appropriate sensor and analysis system, which provides real time detection of incoming projectiles and other threats and generates activation signals to actuator 150.

Figure 3:
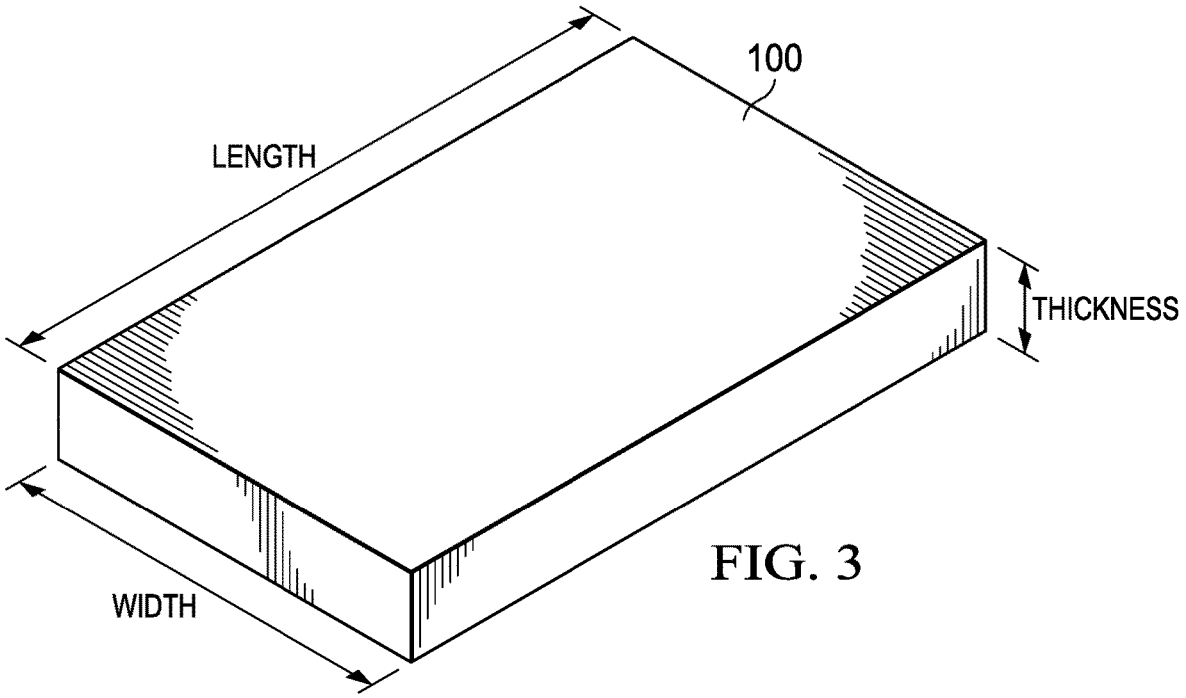
FIG. 3 illustrates the dimensions of the armor panel.

FIG. 3 illustrates the length, thickness, and width dimensions of an example armor panel 100. An example of panel dimensions is 3 feet in width, 2 feet in length, and 2 inches in thickness. A wide range of variation is possible. A particular vehicle or other protected equipment can have multiple panels of varying dimensions.

As illustrated by the arrows in FIG. 1, armor panel 100 moves both translationally and rotationally to intercept projectile 11 edge-on. The panel 100 moves translationally on track 110 along the surface of vehicle 10 from Position C to Position D, or to any position between and beyond. The translational movement can be vertical relative to the base of the vehicle or other equipment, as shown herein. Alternatively, the translational motion can be horizontal, or even along a diagonal. Panel 100 moves rotationally from Position A to Position B, or to any position between. Rotational movement from Position E along the translational path is shown, but the rotational movement can be from any of its translational positions between Position C and Position D.

Typically, the rotational movement during deployment is around ninety degrees, that is, from angular Position A to angular Position B. In its undeployed position, armor panel 100 lies flat or nearly flat against the surface of the vehicle 10 (in angular Position A), positioned along any of the translational positions from Position C to Position D.

For the example dimensions of FIG. 3, a vehicle (or other protected equipment) protected with one or more armor panels 100 can provide two feet (its length) of armor thickness (with its panel deployed rotationally to Position B) to defeat a threat. This can be compared to a conventional two-to-three-inch armor plate mounted conventionally on the exterior of a vehicle.

Because of the high speed of most expected threats, the armor panel 100 need only "fly through" the desired location to meet the threat. A full edge-on deployment is illustrated as Position B, but a projectile can be effectively slowed even when the armor panel is not exactly edge-on. In other words, the panel 100 does not need to be stopped and held in a specific position. When the panel is not deployed (Position A) it can provide armor protection to the vehicle for lesser threats over a larger area. Less than full edge-on protection is provided in positions between Position A and Position B.

Armor panel 100 can be made from various materials. Examples are monolithic metal, spaced/angled plates, ceramics, encapsulated ceramics, glasses, encapsulated glasses, and/or composite material. Existing armor panels can be re-configured for the moveable use of this description. However, as compared to conventional armor, it is expected that a thinner and/or lighter panel will provide as good or better protection.

Experimentation with a tungsten alloy projectile indicates that striking an armor steel panel edge-on will erode the projectile and prevent damage to protected equipment. The protection is successful for both center and off-center hits.

Figure 4:
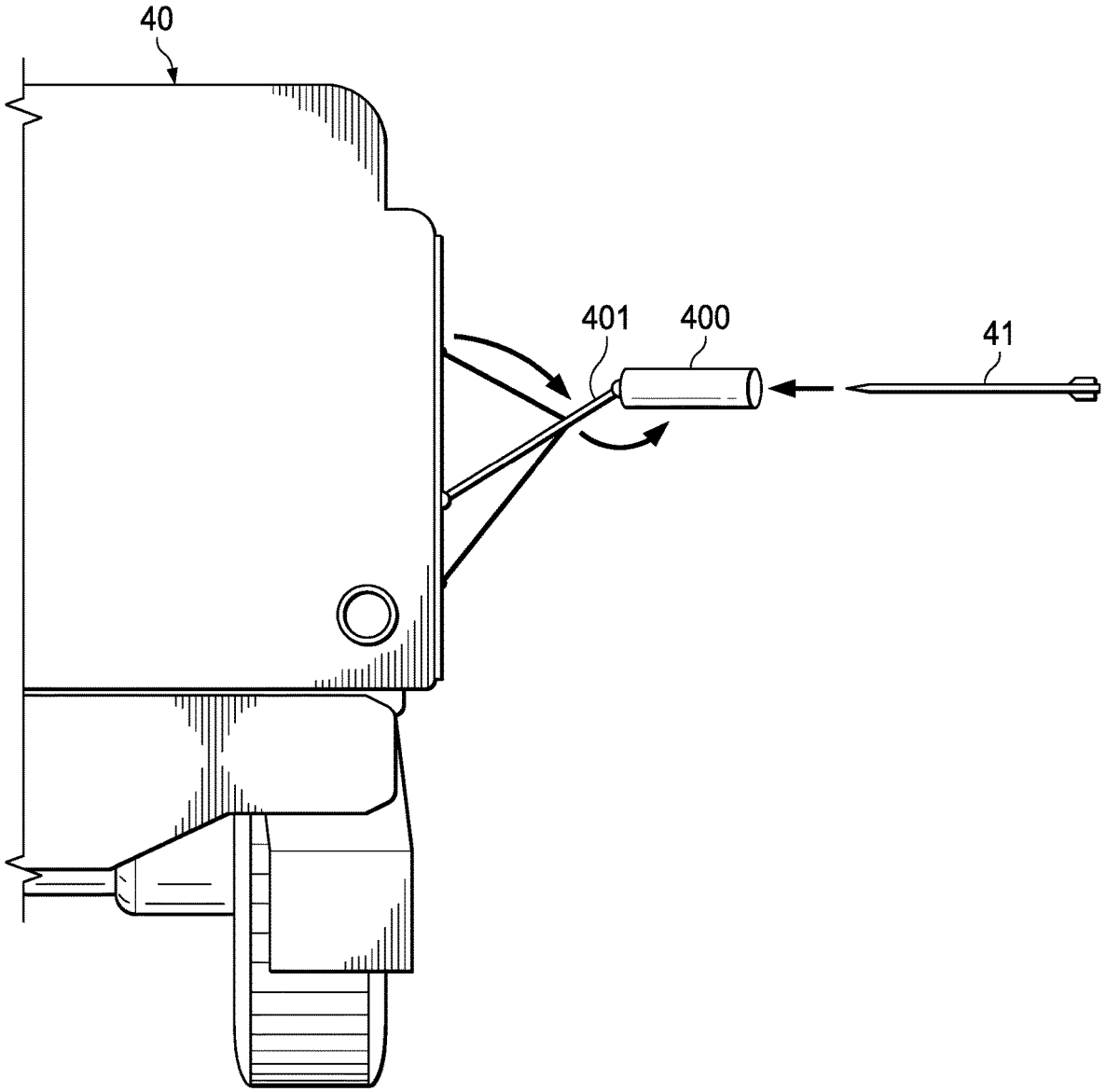
FIG. 4 is a side view of a pike armor panel installed on a vehicle, in a deployed position.
Figure 5:
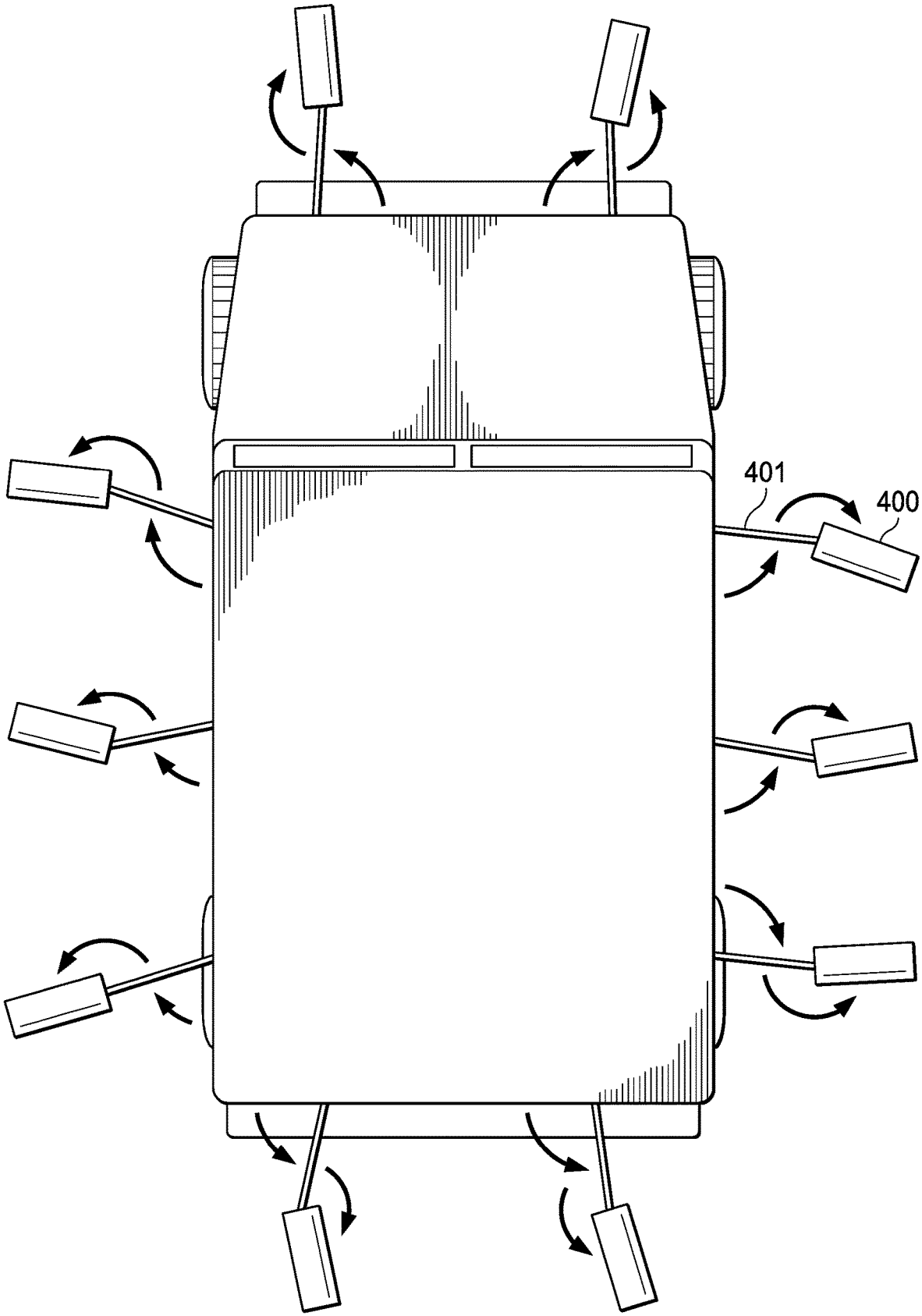
FIG. 5 is a top view of a number of pike armor panels in deployed positions.

FIGS. 4 and 5 illustrate a "pike" configuration of armor panels 400 installed on a vehicle 40. In this configuration, the width and thickness of each panel 400 are similar.

FIG. 4 is a side view, with one panel 400 deployed. FIG. 5 is a top view, showing a number of panels 400 deployed.

As with the flat armor panels of FIGS. 1-3, the armor panels 400 move rotationally to point out from the vehicle 10 when deployed. When not deployed, panels 400 are folded against vehicle 10.

Each panel 400 is supported and transported by an arm 401, which is attached to vehicle 40 at one end and to panel 400 at the other. As indicated by the arrows in FIGS. 4 and 5, the arm 401 moves panel 400 both rotationally and translationally.

Armor Panel Mechanics and Actuation

There are several possible strategies for rapidly activating the translational and rotational motion of the armor panel. The description below is directed to the following three approaches: 1) electromechanical approach, 2) gas generator approach, and 3) combined electromechanical and gas generator approach. Each of these activation approaches can be used with similar mechanical linkages to moveably attach the armor panel to the protected equipment.

Figure 6:
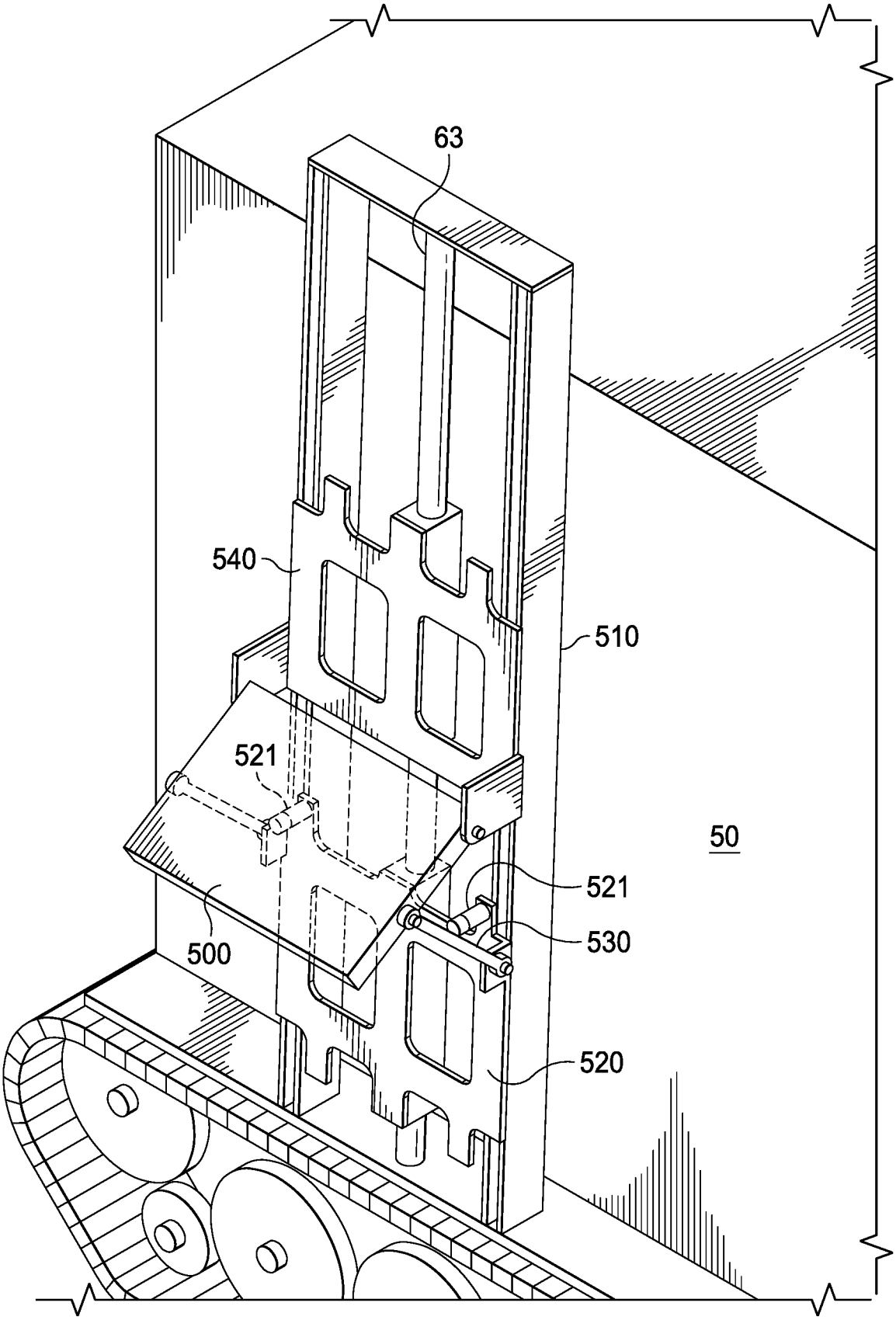
FIG. 6 illustrates the mechanical track, sleds, and linkages for attaching the armor panel to a vehicle and for facilitating motion of the armor panel.

FIG. 6 illustrates an example of a mechanical implementation for both rotational and translational movement of an armor panel 500. In addition to armor panel 500, the same concepts apply to the armor panels described above.

A track 510 is mounted on the protected equipment, a portion of whose surface is shown. The translational movement is vertical in FIG. 6. Two sleds, a lower sled 520 and an upper sled 540, move translationally along, and are guided by, track 510. Two arms 530 connect armor panel 500 to lower sled 520, one arm 530 on each side of armor panel 500 (along its length). Each arm 530 has pivotal connections to armor panel 500 at both ends of arm 530, so that panel 500 can move rotationally. In the example of FIG. 6, the attachment of an upper end of each arm 530 is approximately at the midpoint of the side of the armor panel. At the upper corner of the armor panel, a pivotal connection is made to the upper sled 540.

The two sleds 520 and 540 move independently on track 510. Their relative spacing from each other along track 510 provides the rotational movement of armor panel 500, via arms 530. The closer the spacing between sleds 520 and 540, the greater the rotation angle of the armor panel 500. Sleds 520 and 540 are made from a lightweight and rigid material. In the example of this description, sleds 520 and 540 are plates with openings to reduce their weight. Lower sled 520 has bars 521 protruding toward armor panel 500, against which armor panel 500 rests when not deployed.

In FIG. 6, armor panel 500 is shown in a 45-degree position, which is not an edge-on (90 degree) position, but does provide protection as described above. Linkage arms 530 allow panel to be nearly flat against surface 50 when not deployed, or to be rotated to and optionally past 90 degrees. A typical undeployed position of panel 500 is about 8 degrees, with the angle of linkage 530 providing a moment arm to start rotational motion. Other linkage designs can be used if it is desired to stow panel 500 in a flat (vertical) position against the surface of the vehicle.

As alternatives to the mechanical configuration of FIG. 6, various other mechanisms, such as linkages, rails, bearings, shafts, cables, and/or wheels, are possible. In general, each armor panel has some sort of translational track, and some sort of rotational arm(s). By "track" is meant a rail to which one or more sleds can be attached in a manner such that the sled is attached to and can move along the track.

Referring again to FIG. 1, monitor 140 provides data to actuator 150 representing the current position and/or velocity of the armor panel 500. Various methods of ensuring that the armor panel 500 is in the correct place are possible. Examples of position monitoring devices are optical cameras, encoders on tracks and rotary wheels. Motion monitoring devices such as inertial measurement sensors, accelerometers and gyroscopes can be mounted on the armor panel.

For activating movement of armor panel 500, in general, each actuation approach implements an actuator 150 that allows independent movement of upper sled 540 and lower sled 520. Thus, actuator 150 may comprise a system of motors, or gas generators, or a combination of both.

One implementation of actuator 150 is an electromechanical actuator. In this case, actuator 150 comprises at least one electric motor, connected to panel 100 through mechanical linkages. The motor can be linear or rotary and can interface to the mechanism with the use of tracks, pulleys, cables, etc. Current to the motor is controlled to control the motion to ensure the armor panel 100 is in the correct place at the correct time. Batteries, flywheels, or explosive generators or other means can provide the required electrical power on the vehicle.

Figure 7:
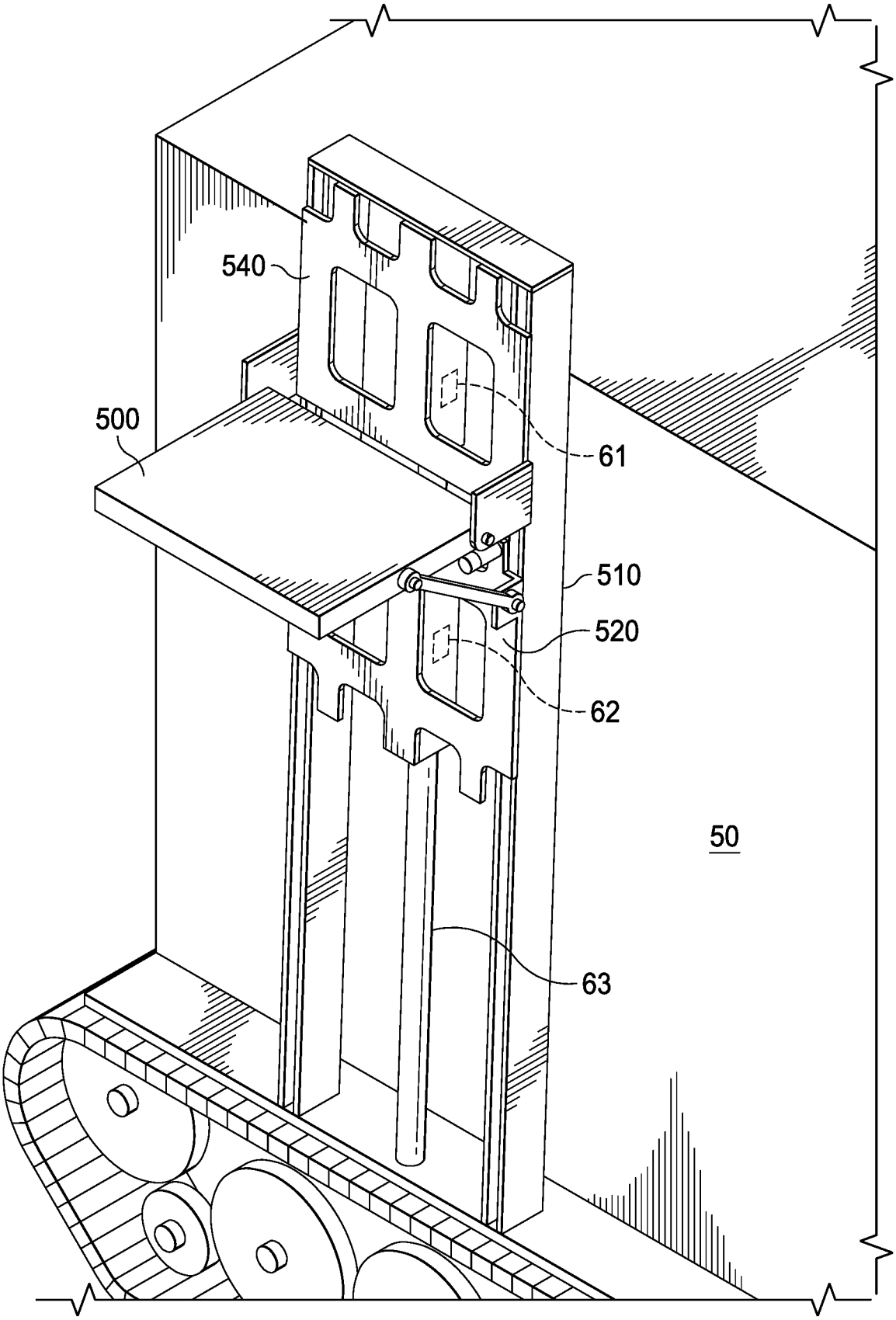
FIG. 7 illustrates how the armor panel system of FIG. 6 may be actuated with an actuator comprising linear motors.

FIG. 7 illustrates how a linear electric motor actuator 150 may be used for both translation and rotation. Actuator 150 comprises two electromagnetic linear motors 61 and 62. Each sled 520 and 540 has an associated motor. Armor panel 500 is shown in a deployed edge-on (90 degree rotation) position.

Motors 61 and 62 are attached to and travel along a center magnetic shaft 63, which is parallel to track 510. As stated above, sleds 520 and 540 move along track 510 independently. Both sleds move translationally, but not necessarily the same distance along track 510. The relative distance between them determines the rotational position of armor panel 500.

Experimentation with an electric motor actuator 150 has resulted in rotation from 8 degrees (folded down) to 110 degrees of panel 500 with three foot translational motion. This deployment was achieved in less than 0.5 seconds. Six feet of motion with 90 degrees of rotation has been achieved in 0.7 seconds.

Another implementation for actuator 150 is with one or more gas generators. Examples of gas generators are airbag inflators, dilute explosives, or traditional high explosives, to provide an energetic impulsive motion of the armor panel. A piston/cylinder configuration, in which the expanding gas moves a piston inside of a cylinder, can be used to provide locomotion to the armor panel through linkages, cables, or directly driving motion with gaseous exhaust. This method can be used to induce both linear and rotational motion on tracks or shafts. It is expected that each sled would have an associated gas generator. For gas generator actuator, motion can be controlled and tuned with the use of a mechanical friction braking system that slows panel rotation or translation to position it at the required location at the required time.

A third implementation of actuator 150 is with a combined electromechanical and gas generator approach. One or more gas generators provide an initial impulse to the armor panel, with subsequent motion and control supplied by linear electric motors similar to those of FIG. 6. In experimentation, with a 200 pound panel, this type of actuator achieved controlled motion of 6 feet of translational motion and 90 degrees of rotary motion in less than 0.4 seconds.

Figure 8:
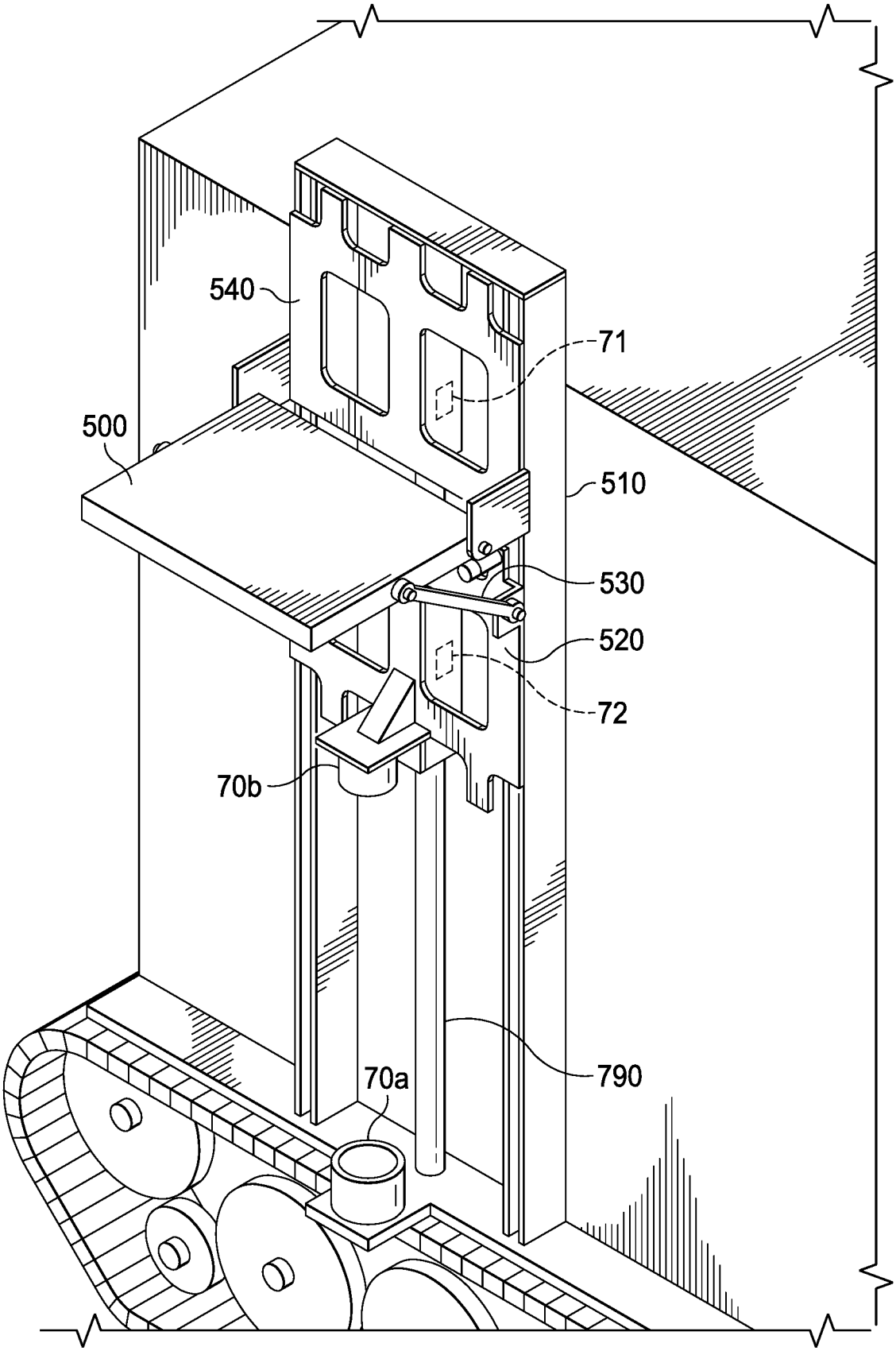
FIGS. 8 and 9 illustrates how the armor panel system of FIG. 6 may be actuated by, or have its actuation assisted by, an actuator comprising a gas generator.

FIG. 8 illustrates panel 500 deployed into an edge-on position, using an actuator 150 that is a combination of a gas generator 70 and electric motors 71 and 72. The gas assist provided by the gas generator 70 provides both rotational and upward translational movement of both sleds. The extent of which type of motion is more assisted depends on timing control of motors 71 and 72.

Figure 9:
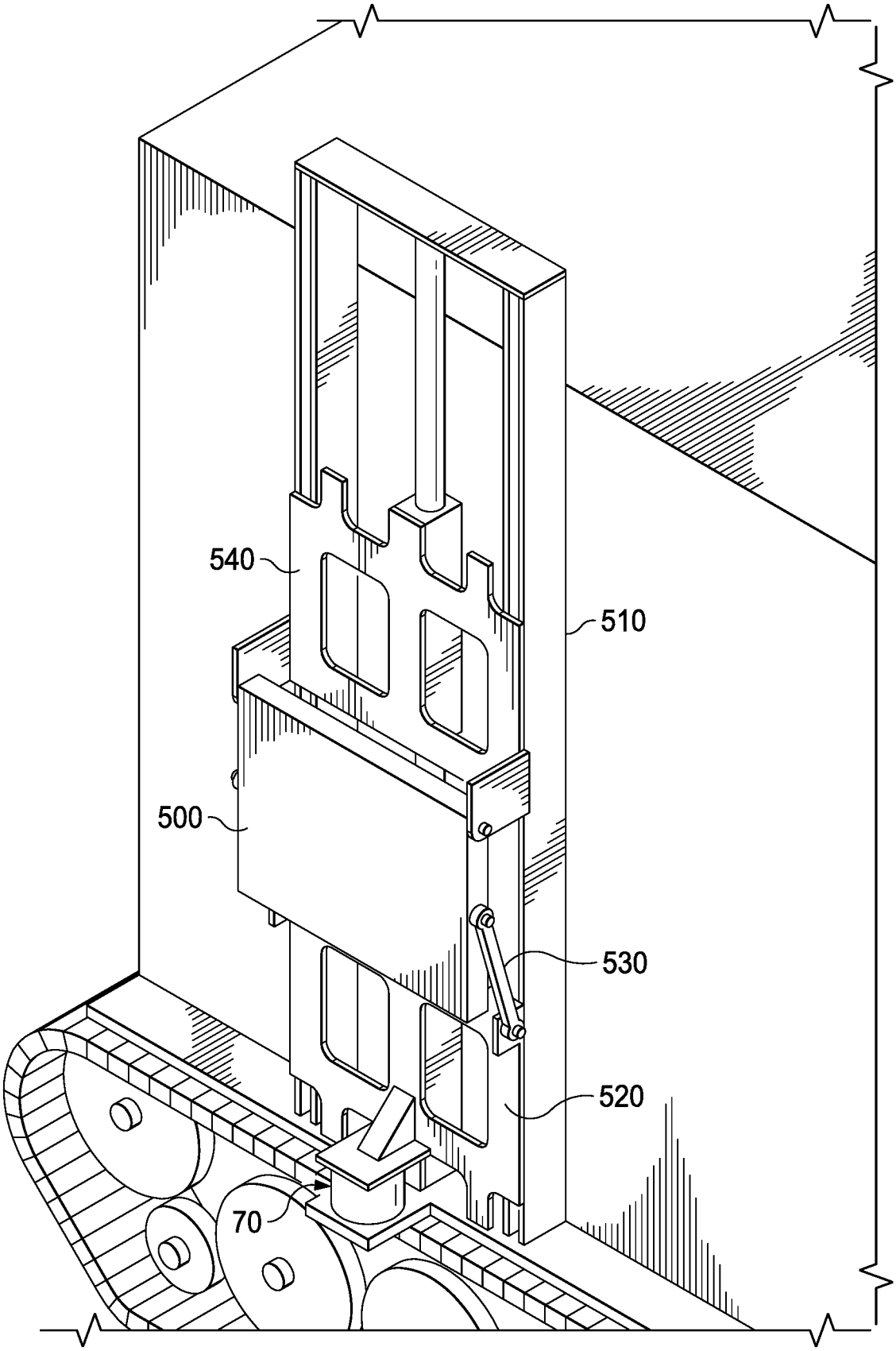

Gas generator 70 is shown in its post-burn deployed state in FIG. 8, with armor panel 500 deployed. FIG. 9 illustrates armor panel 500 in a pre-ignited undeployed state.

Referring to both FIGS. 8 and 9, gas generator 70 comprises a cylinder 70*a* and piston 70*b*. In the non-exploded state of gas generator 70 piston 70*b* fits tightly inside cylinder 70*a*. When gas generator 70 is triggered, piston 70*b* is rapidly and explosively pushed apart from cylinder 70*a*. These two elements separate after several inches of travel. Cylinder 70*a* is attached to the bottom of track 510, and does not move. Piston 70*b* is attached to bottom sled 520 and travels with bottom sled 520.

For all implementations of actuator 150, actuator 150 is assumed to have appropriate software and hardware to receive input regarding when to activate in response to an incoming projectile, as well as input from monitor 140. Actuator 150 is further programmed to process this input, and to trigger actuation of armor panel 500 achieve the desired motion in the desired time.

Actuator 150 may be programmed to optimize the translational position, the rotational position, and the timing of movement of the armor panel. Once an incoming threat is sensed, the control parameters for moving armor panel 500 must be optimized. The control parameters optimized for one target (e.g. 6' of translation, 90 degrees rotation, in 0.4 seconds) do not necessarily translate for other targets (e.g. 1' translation, 90 degrees rotation, in 0.3 seconds). The target is known only moments before the armor panel must move, thus real time response is required. Simulations may be used to pre-compute optimal position/angle/time of the armor panel in response to various threats. Actuator 150 can then store look-up tables representing these optimizations, to aid in real-time activation. Similarly, for gas generator implementations, simulations can be used to determine optimal times to trigger brakes, if any, to result in a desired position/angle/time.

What is claimed is:

1. An armor system for protecting equipment against projectiles and similar threats, comprising:

a track mounted on the equipment;

an upper sled moveably attached to the track; a lower sled moveably attached to the track; wherein the upper sled and lower sled are independently moveable along the track;

at least one armor panel having rectangular dimensions, with a length, width, and thickness, and having a projectile-facing edge and an equipment-facing edge;

wherein the armor panel is pivotally connected to the upper sled at the equipment-facing edge;

at least one arm for connecting the armor panel, at a point along its length, to the lower sled, wherein the connections are pivotal at both ends of the arm; and an actuator for providing translational motion to the upper sled and the lower sled;

wherein the actuator controls the translational motion of the upper sled independently of the motion of the lower sled.

2. The armor system of claim 1, wherein the actuator comprises a pair of linear motors on a central shaft parallel to the track, the upper sled and lower sled each being moved with an associated one of the pair of linear motors.

3. The armor system of claim 1, wherein the actuator comprises a gas generator, which drives both the upper sled and lower sled along the track.

4. The armor system of claim 1, wherein the actuator comprises a gas generator, and a pair of linear motors.

5. The armor system of claim 1, wherein the armor panel has a thickness and width of approximately the same dimensions, and wherein a number of such armor panels are installed in a pike configuration.

6. The armor system of claim 1, further comprising a position monitor for detecting the current position of the panel, and providing position data to the actuator.

7. The armor system of claim 1, wherein the translational motion is vertical relative to the base of the vehicle.

8. The armor system of claim 1, wherein the translational motion is horizontal relative to the base of the vehicle.

9. The armor system of claim 1, wherein the armor panel is pivotally connected to provide a rotational motion of at least 90 degrees, from a nearly flat position against the surface of the equipment to a position extending outward from the surface of the equipment.

* * * * *